US010329799B2

(12) United States Patent
Hastings et al.

(10) Patent No.: US 10,329,799 B2
(45) Date of Patent: Jun. 25, 2019

(54) LATCH MECHANISM WITH STATUS INDICATOR

(71) Applicant: Southco, Inc., Concordville, PA (US)

(72) Inventors: Brandon V. Hastings, Hemlock, NY (US); Richard B. Langkamp, Jr., Hemlock, NY (US); Tommy Vu Phi Nguyen, Victor, NY (US)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 15/647,750

(22) Filed: Jul. 12, 2017

(65) Prior Publication Data

US 2017/0306651 A1 Oct. 26, 2017

Related U.S. Application Data

(63) Continuation of application No. PCT/US2017/020668, filed on Mar. 3, 2017.
(Continued)

(51) Int. Cl.
*E05B 41/00* (2006.01)
*E05B 39/00* (2006.01)
(Continued)

(52) U.S. Cl.
CPC ..... *E05B 41/00* (2013.01); *E05B 17/22* (2013.01); *E05B 39/00* (2013.01); *E05B 85/08* (2013.01);
(Continued)

(58) Field of Classification Search
CPC .... E05B 17/0091; E05B 17/22; E05B 17/226; E05B 39/00; E05B 39/007; E05B 41/00
See application file for complete search history.

(56) References Cited

U.S. PATENT DOCUMENTS 747,252 A * 12/1903 Smith ..... E05B 41/00 40/460
1,529,766 A * 3/1925 Bina ..... G09F 7/00 40/460
(Continued)

FOREIGN PATENT DOCUMENTS

DE 202010012699 U1 12/2010
DE 202014104058 U1 9/2014
WO 2017011443 A1 1/2017

OTHER PUBLICATIONS

E3 Vise Action Compression Latch Overview, 2013, 21 pages.
(Continued)

*Primary Examiner* — Christopher J Boswell
(74) *Attorney, Agent, or Firm* — RatnerPrestia

(57) ABSTRACT

A latch mechanism is provided that includes a housing, a cap, and at least one indicator. The cap may include a central axis and may be mounted for selective rotational movement relative to the housing about the central axis between a latched position and an unlatched position. The at least one indicator may be interposed between the cap and the housing, such that the cap is in covering relationship to at least a portion of the at least one indicator. The at least one indicator may also be mounted for radial movement outwardly from the central axis relative to the cap as the cap is rotated from the latched position to the unlatched position such that the cap is no longer in covering relationship to the portion of the at least one indicator.

19 Claims, 29 Drawing Sheets

Related U.S. Application Data

(60) Provisional application No. 62/303,112, filed on Mar. 3, 2016.

(51) Int. Cl.

| | |
|---|---|
| ***E05B 17/22*** | (2006.01) |
| ***E05C 3/04*** | (2006.01) |
| ***E05B 85/08*** | (2014.01) |
| ***E05C 3/06*** | (2006.01) |
| *E05B 35/00* | (2006.01) |
| *E05C 5/02* | (2006.01) |
| *E05B 85/00* | (2014.01) |
| *E05C 3/00* | (2006.01) |

(52) U.S. Cl.

CPC ..... *E05C 3/042* (2013.01); *E05C 3/06* (2013.01); *E05B 35/008* (2013.01); *E05B 85/00* (2013.01); *E05C 3/00* (2013.01); *E05C 5/02* (2013.01)

(56) References Cited

U.S. PATENT DOCUMENTS 4,583,775 A 4/1986 Bisbing
5,301,988 A * 4/1994 Davenport ..... E05B 41/00 292/1
6,640,592 B2 11/2003 Vickers
7,467,531 B2 * 12/2008 Lai ..... E05B 37/025 70/337
8,336,931 B2 12/2012 Cotton et al.
9,845,620 B2 * 12/2017 Bronner ..... E05B 63/0017
2008/0000277 A1 * 1/2008 Yu ..... E05B 29/00 70/432
2008/0190150 A1 * 8/2008 Hoffmann ..... E05B 9/08 70/91
2009/0031764 A1 * 2/2009 Huang ..... E05B 35/105 70/21
2013/0205848 A1 8/2013 Langenberg et al.
2015/0240526 A1 8/2015 Clary et al.

OTHER PUBLICATIONS

EMKA Beschlagteile, "Compression Latch With Optical Opening Indicator", 2014, 1 page.
EMKA Catalog p. 1B-237, "Compression Latch With Visual Open Indicator", downloaded http://www.emka.com/de_en/quarter-turns/standard/compression-latch-with-visible-indicator, Jun. 3, 2015, 3 pages.
Compression Lock "Double Red with Double Optical Opening Indicator for Stow Box Program 1000", 2014, 2 pages.
Dirak, 1-075 Compression Latch Pr22.1, 2016, 2 pages.
Dirak "1-271E LED module for Quarter-Turn Pr20.1 to indicate the locking status", 2009, 2 pages.
International Search Report for International Application No. PCT/US2017/020668, dated May 23, 2017, 9 pages.
International Preliminary Report on Patentability and Written Opinion for International Application No. PCT/US2017/020668, dated Sep. 4, 2018, 6 pages.

* cited by examiner

LATCH MECHANISM WITH STATUS INDICATOR

CROSS REFERENCE TO RELATED APPLICATION

This application is a continuation patent application of PCT Patent Application No. PCT/US2017/020668, filed Mar. 3, 2017, which claims priority to U.S. Provisional Patent Application No. 62/303,112, filed Mar. 3, 2016, the disclosure of these applications being incorporated herein by reference in their entirety for all purposes.

FIELD OF THE INVENTION

The present invention relates generally to latching devices and more particularly to latching devices for securing a first member such as a door, panel or the like in a closed position relative to a second member such as a corresponding door, panel or frame.

BACKGROUND OF THE INVENTION

Various types of latching devices for use in securing a first closure member such as a door, panel or the like in a closed position relative to a corresponding second closure member such as a door, panel or frame are known. Some types incorporate a pawl or similar latching member that is actuated to engage a closure member for latching.

In certain applications, it is desirable to know whether the mechanism is in a latched or unlatched state. For example, latches used to secure the door of a baggage compartment of a coach bus or a train, for example, may be inspected prior to beginning a journey. If the latch is not properly locked, the stored luggage belonging to the passengers may be inadvertently lost, if the compartment door opens while in transit, or the baggage may be stolen during the excursion, if the storage compartment is not properly secured and left unattended.

SUMMARY OF THE INVENTION

In one aspect of the present invention, a latch mechanism is provided that comprises a housing, a cap, and at least one indicator. The cap may include a central axis and may be mounted for selective rotational movement relative to the housing about the central axis between a latched position and an unlatched position. At least one indicator may be interposed between the cap and the housing, such that the cap is covering at least a portion of at least one indicator. The at least one indicator may also be mounted for radial movement outwardly from the central axis relative to the cap as the cap is rotated from the latched position to the unlatched position such that the cap is no longer in a covering relationship to the portion of at least one indicator.

BRIEF DESCRIPTION OF THE DRAWINGS

The above and other aspects and features of the present invention will become more apparent to those of ordinary skill in the art by describing in detail exemplary embodiments thereof with reference to the attached drawings, in which.

DETAILED DESCRIPTION OF THE INVENTION

Figure 1A:
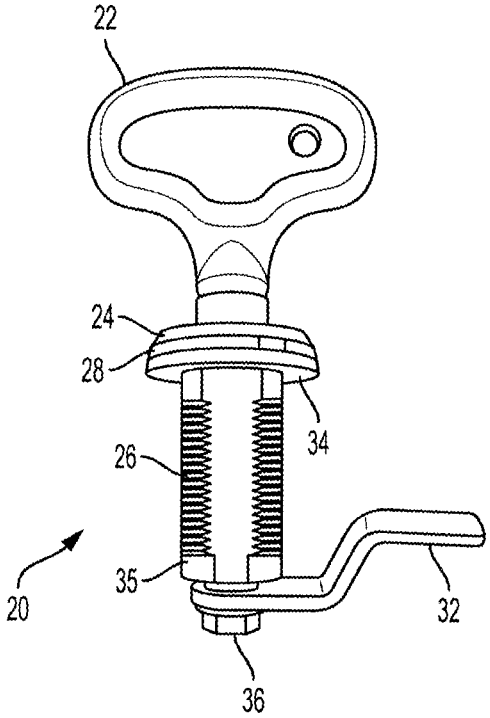
FIG. 1*a* is a side view of a latch mechanism in a latched state and a key according to an embodiment of the present invention.
Figure 1B:
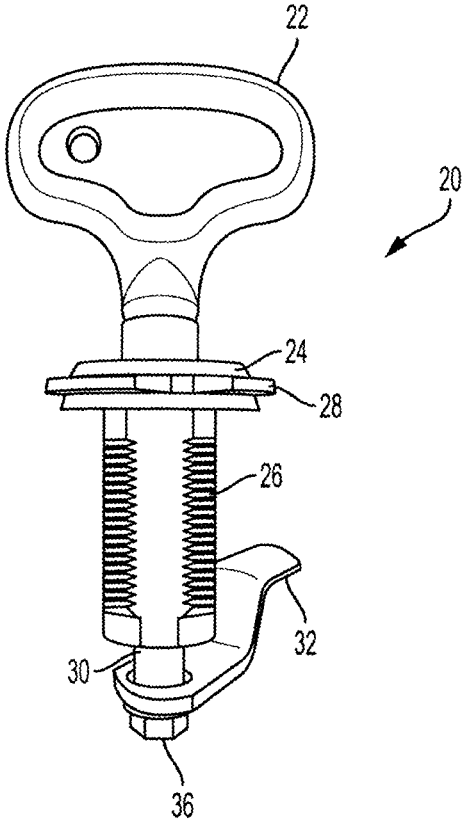
FIG. 1*b* is a side view of the latch mechanism and key in FIG. 1*a* in an unlatched state.
Figure 2A:
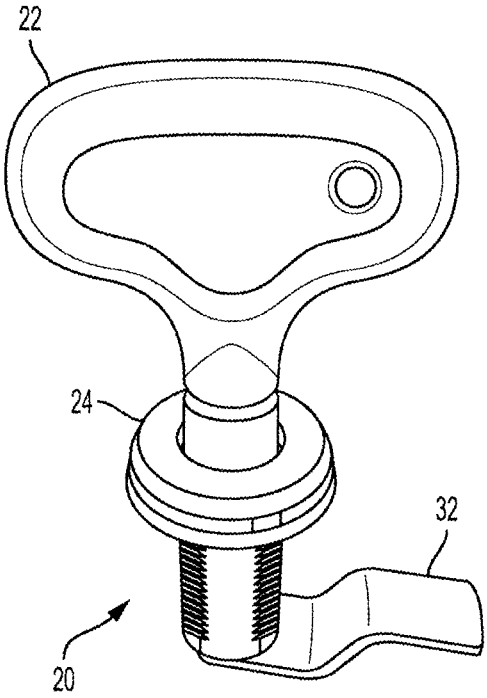
FIG. 2*a* is top perspective view of the latch mechanism and key in FIG. 1*a* in the latched state.
Figure 2B:
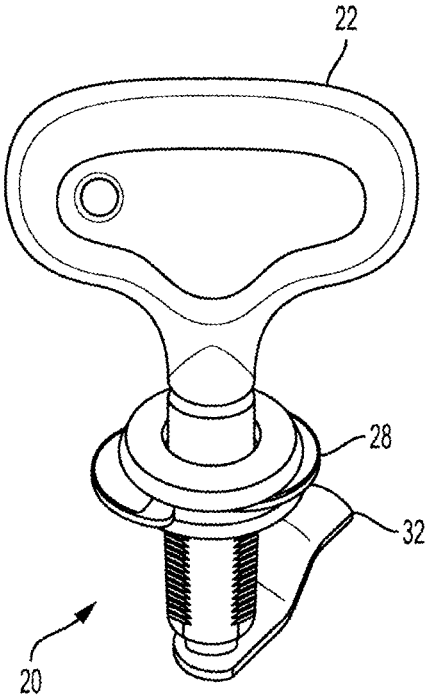
FIG. 2*b* is top perspective view of the latch mechanism and key in FIG. 1*a* in the unlatched state.

The invention will now be described by reference to exemplary embodiments and variations of those embodiments. Although the invention is illustrated and described herein with reference to specific embodiments, the invention is not intended to be limited to the details shown and described. Rather, various modifications may be made in the details within the scope and range of equivalents of the claims and without departing from the invention.

According to various embodiments of the present invention, a latch mechanism is provided that comprises a housing and a cap configured to rotate relative to one another and cause one or more indicators that may, for example, be wing-shaped to extend as the latch mechanism is unlatched. The starting withdrawn position of the indicators may be closer to the central axis of the cap and/or housing when latched and extend out radially as the cap is rotated to the unlatched condition. The indicators may immediately pivot or otherwise move radially outwardly and reach their fully extended position, for example, within the first five degrees of rotation of the cap, and remain in the fully extended position for the remaining rotation of the cap to the unlatched condition. For example, if a 180 degree rotation of the cap will unlock the latch mechanism, the indicators may extend within the first five degrees of unlocking rotation of the cap and maintain the fully extended position for the remaining 175 degrees of rotation. It is preferred to configure the latch mechanism, such that the indicators reach their fully extended position and maintain this position for as much of the rotation of the cap as possible to eliminate the impression of a 'false-locked' condition in which the indicators are withdrawn, but the latch is not fully closed. The indicators may be color coded, such as a bright red color that may be generally visible at least 5 meters away, to warn an operator that the latch is not fully closed, which may be critical in transportation applications, such as on a train or moving vehicle. Springs or other biasing means are optional, but may be included in some embodiments, to facilitate actuation of the indicators. The indicator's motion may be completely controlled by the rotation of the cap or may be controlled by the housing geometry. Therefore, the indicators may pivot about an axis that is fixed relative to the cap or the housing, for example.

Referring now to FIGS. 1*a*, 1*b*, 2*a*, and 2*b*, a latch mechanism 20 according to a first embodiment of the present invention is provided in combination with a driver in the form of a key 22 for actuating the latch mechanism 20 between a latched and unlatched state. As would be appreciated by those of skill in the art, other driving means may be used to actuate a latch mechanism made according to the various embodiments of the present invention. For example in applications in which security is not a concern, the driver may be a handle or knob attached to the latch mechanism. The latch mechanism 20 may further comprise a cap 24 configured to receive the key 22 and a housing 26. The cap 24 may, for example, be mounted for rotational movement relative to the housing 26. One or more indicators 28 may be interposed between the cap 24 and housing 26 at a first end 34 of the housing 26.

The latch mechanism according to the present invention may be provided in the form of various types of latches, such as a simple cam latch. The inner features of the latch may allow axial and/or rotational movement of the pawl. In one embodiment of the present invention, the latch mechanism may be provided in the form of a cam latch, such as the latch described in U.S. Pat. No. 6,640,592, the contents of which are incorporated herein by reference in its entirety. For example, the opposing second end 35 of the housing 26 may be provided with an opening, and a shaft 30, positioned at least in part within the housing 26, may extend through the opening. The shaft 30 may be operatively connected to the cap 24. A pawl 32 may be attached to an end of the shaft 30 using a fastening means, such as a screw 36. The outer surface of the housing 26 may also be provided with interrupted screw threads along a portion of the outer surface thereof. The screw threads on the outer surface of the housing 26 may be interrupted by two or more flats, preferably at least four flats, formed on the outer surface of the housing 26. The flats formed on the outer surface of the housing 30 prevent the rotation of the housing 26 when the key 22 is used to turn the cap 24, once the latch 20 is installed in a closure member such as a door or the door's frame. The interrupted threads on the outer surface of the housing 26 are engaged by a nut (not shown) to secure the latch 20 in place, once the latch 20 is installed in a closure member such as a door or the door's frame.

The cam latch may include a cam (not shown) having at least one cam slot. The cam may be rotatably supported within the housing 26, as well as operatively connected to the cap 24, so as to rotate in response to rotation of the cap 24 from the latched condition to the unlatched condition. The shaft 30 may include a cam follower located within the cam slot, which may be configured such that the shaft 30 and the pawl 32 rotate in unison and also shift axially away from the second end 35 of the housing 26 as the cap moves between the unlatched position and the latched position.

Figure 3A:
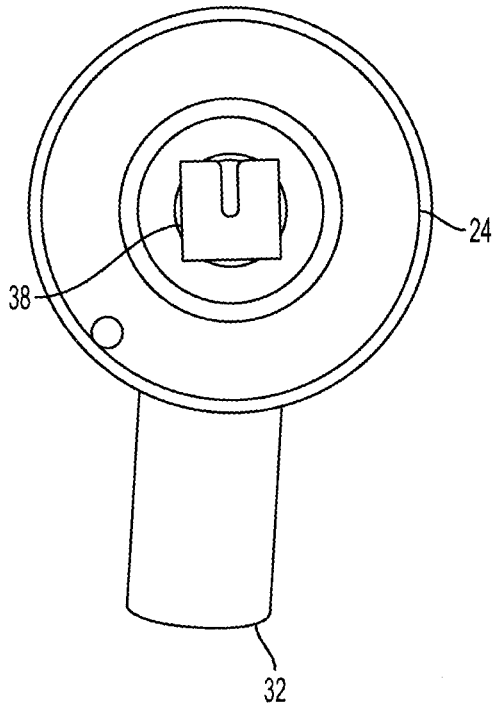
FIG. 3*a* is top plan view of the latch mechanism in FIG. 1*a* in the latched state.

In order to indicate whether the latching mechanism is in the latched or unlatched condition, the one or more indicators 28 alternate between a withdrawn condition and an extended condition. For example in the withdrawn condition as provided in FIG. 3*a*, the indicators 28 are substantially obscured from view because the cap 24 is in a covering relationship to the indicators 28. The withdrawn condition of the indicators therefore corresponds to the latched condition of the latching mechanism. The cap 24 includes a square-shaped male portion 38, which mates with a corresponding female portion of the key 22 having a similar square shape. As would be appreciated by those of skill in the art, the male and female portions and shape of the mating portions of the cap and key may be reversed or provided in a number of shapes, e.g. triangle, hexagon, cross, etc. The cap may also alternatively include a lock plug for receiving a toothed key.

Figure 3B:
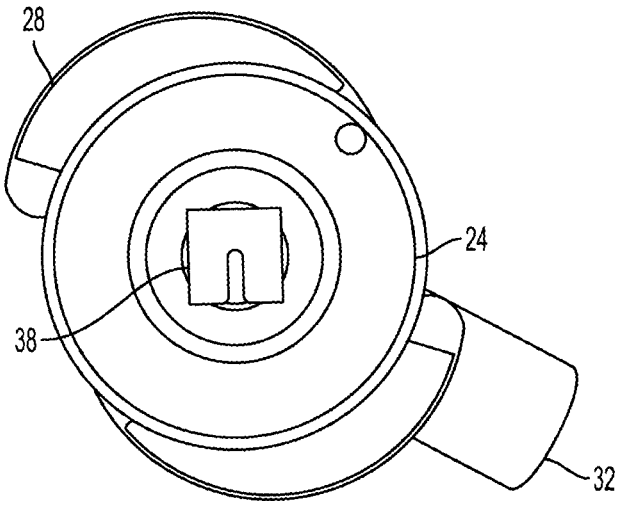
FIG. 3*b* is top plan view of the latch mechanism in FIG. 1*a* in the unlatched state.
Figure 4A:
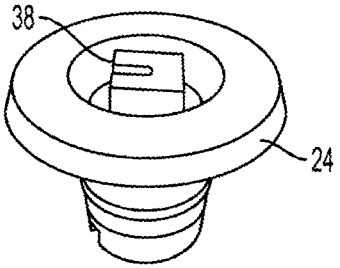
FIG. 4*a* is a top perspective view of a cap of the latch mechanism in FIG. 1*a;*
Figure 4B:
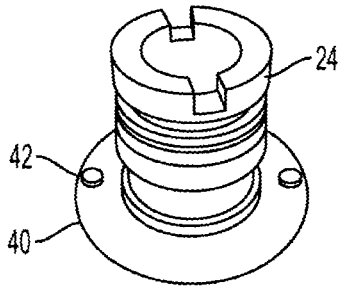
FIG. 4*b* is a bottom perspective view of a cap of the latch mechanism in FIG. 1*a;*
Figure 5A:
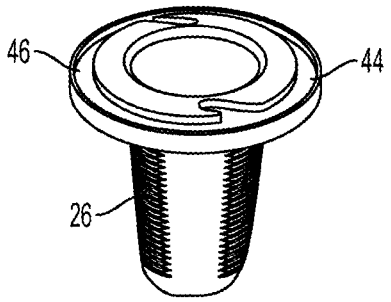
FIG. 5*a* is a top perspective view of a housing of the latch mechanism in FIG. 1*a;*
Figure 5B:
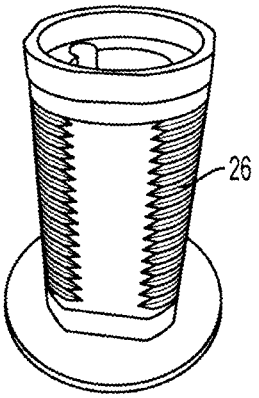
FIG. 5*b* is a bottom perspective view of a housing of the latch mechanism in FIG. 1*a;*

As provided in FIG. 3*b*, the cap 24 has been rotated approximately 180 degrees to the unlatched condition causing the indicators 28 to extend outside of the circumference of the cap 24, such that at least a portion of the indicators 28 are no longer obscured.

It is preferred that the portion of the indicators that are no longer obscured be provided with a color that is different than the color of the cap, such that the indicators when extended are easily recognizable. The portion of the indicator therefore includes a visual enhancement feature. The visual enhancement feature can be a color, a light, a reflector, or any other indicator means that enhances visualization of the indicator. A reflective surface is particularly beneficial at night where a coach driver or a train inspector, for example, using a flashlight can quickly observe either the presence or absence of the reflecting indicator and determine whether one or more compartments are either latched or unlatched.

Figure 6:
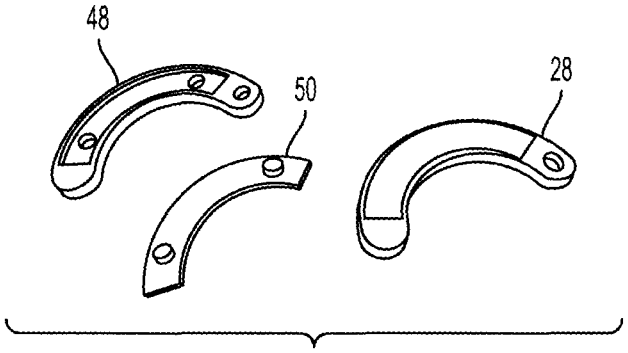
FIG. 6 is a top plan view of an indicator of the latch mechanism in FIG. 1*a;*
Figure 7A:
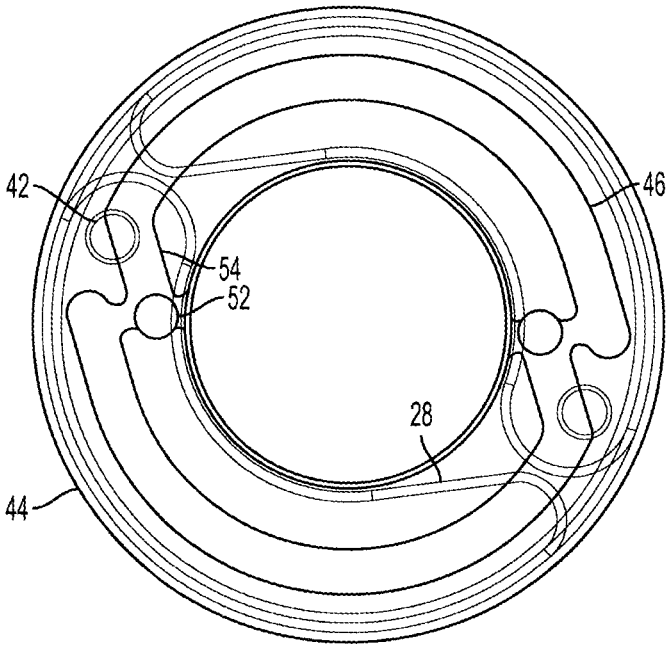
FIG. 7*a* is a top plan view of two indicators and the housing of the latch mechanism in FIG. 1*a* having a translucent cap and indicators.
Figure 7B:
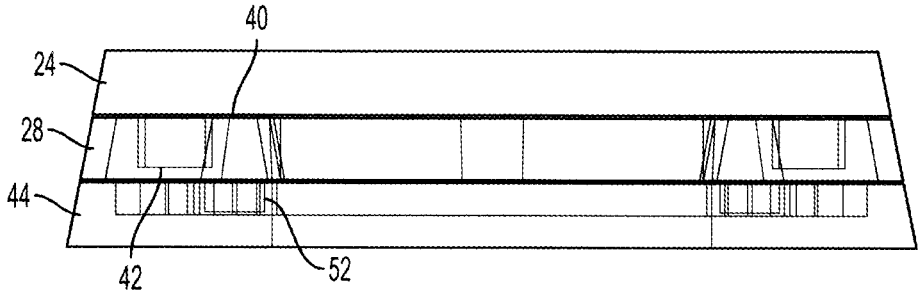
FIG. 7*b* is a side view of the top portion of the latch mechanism in FIG. 1*a* having a translucent housing flange and indicators.
Figure 8A:
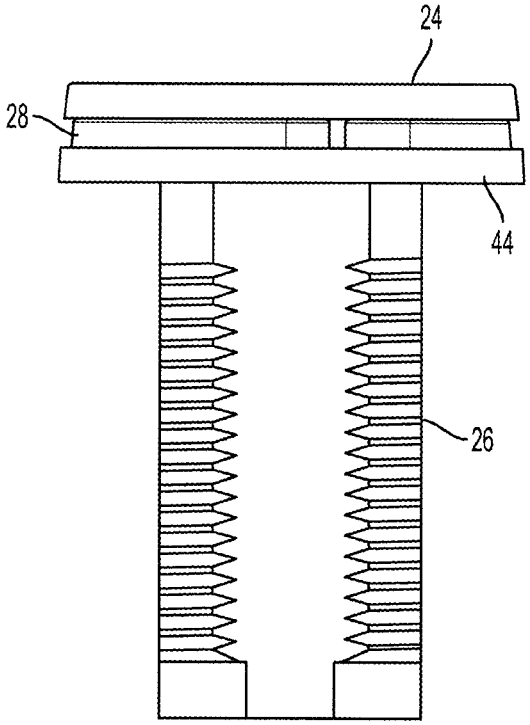
FIG. 8*a* is a side view of a cap, housing, and indicators of the latch mechanism in FIG. 1*a;*
Figure 8B:
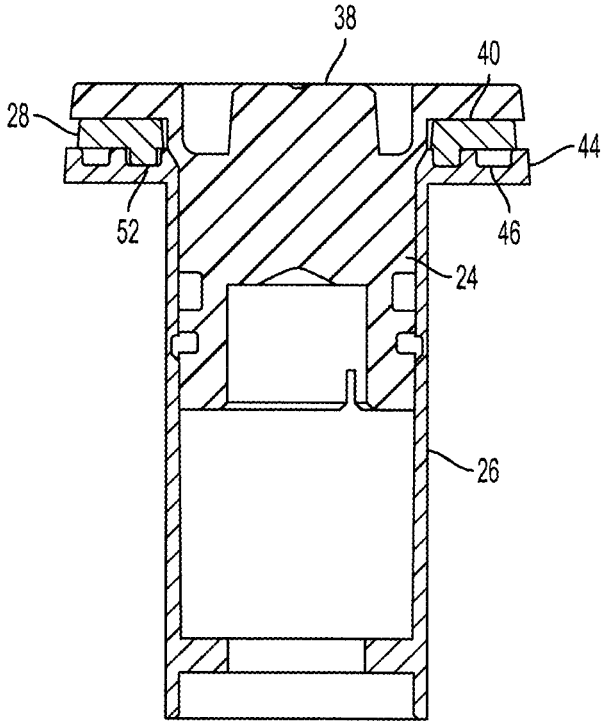
FIG. 8*b* is a cross-section of the side view of the cap, housing, and indicators in FIG. 8*a;*

For example, in the embodiment of FIG. 6, the indicator 28 includes a base portion 48 and a colored insert 50, the colored insert 50 comprising the portion of indicator that is colored differently than the cap and is visible in the extended position. Other means may by incorporated in a latch mechanism according to the present invention for allowing a user to easily recognize that at least a portion of the indicator is in the extended position. For example that indicator may include a light, such as an LED, or a fluorescent or phosphorescent paint may be applied to at least a portion of the indicator, such that it is illuminated in the extended position. The extended position in this embodiment corresponds to the unlatched condition; however, if desired, the correlation between the position of the indicators and the latched and unlatched conditions of the latching mechanism may be reversed.

In order to cause the one or more indicators to transition from a withdrawn position to an extended position when the cap is rotated, one embodiment of the present invention may include one or more grooves 46 in the top surface of a flanged portion 44 of the housing 26. Referring to FIGS. 7*a* to 9*b*, the cap 24 may include a bottom surface 40 that is in opposing relationship to the top surface of the flanged portion 44 of the housing 26. The indicator 28 may be interposed between the top surface and the bottom surface 40. So that the indicator rotates with the cap 24, one or more projections 42 may extend from the bottom surface 40 of the cap 24 and through a corresponding bore in one end of the indicator 28. In some embodiments, the projections may be molded into the bottom surface of the cap, i.e., integral with the cap, and in other embodiments, the projections may be provided in the form a separate pin inserted through the cap and an end of an indicator for example. The side of the indicator 28 adjacent to the top surface of the housing 26 may include a peg 52 extending therefrom. The peg 52 may be positioned within one of the grooves 46 in the top surface of the housing 26. Some embodiments of the present invention may include a plurality of indicators, wherein each indicator has a respective groove in the top surface of the housing. The latch mechanism preferably includes two indicators to provide a symmetrical design that is easy to fabricate and assemble.

Figure 9A:
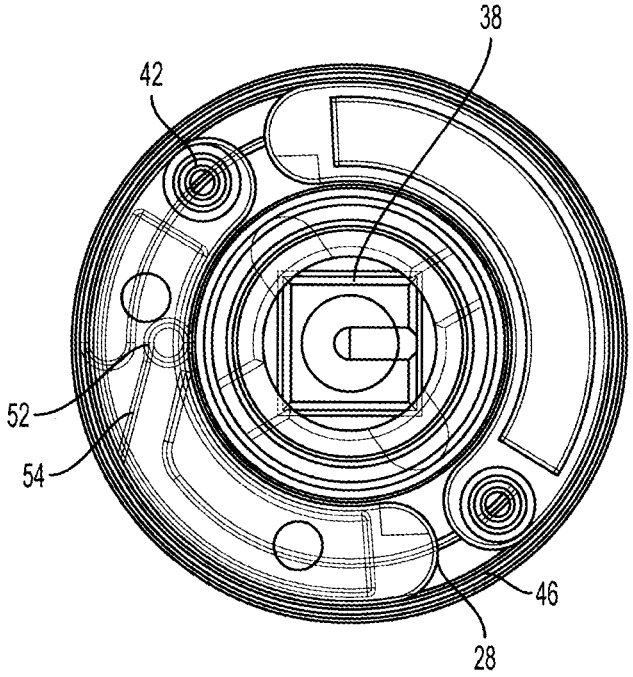
FIG. 9*a* is a top plan view of the latch mechanism in FIG. 1*a* in the latched state having a translucent cap, indicator, and base portion.
Figure 9B:
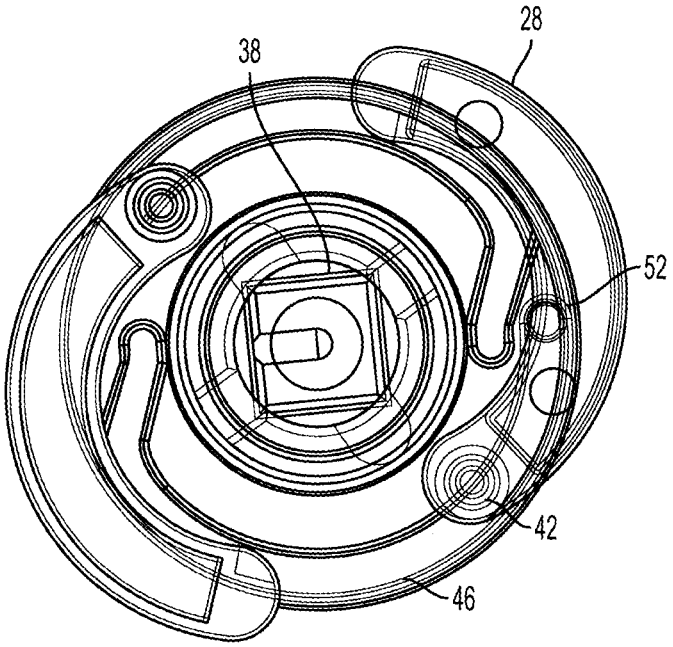
FIG. 9*b* is a top plan view of the latch mechanism in FIG. 1*a* in the unlatched state having a translucent cap, indicator, and base portion.

Referring specifically now to FIGS. 9*a* and 9*b*, as the cap 24 rotates counter-clockwise relative to the housing 28, the indicators also rotate counter-clockwise with the cap 24. The groove 46 includes an angled section 54. The peg 52 of the indicator 28 that is positioned within the groove 46 slides along the angled section 54 causing the indicator 28 to pivot about the projection 42 of the cap 24 during rotation. Upon reaching the end of the angled section 54, the indicators 28 are in the fully extended position and continue to rotate with the cap 24, until the cap 24 has rotated approximately 180 degrees. It is preferred that the location of the peg is located as close as possible to the bore in the indicator to maximize the angle of rotation when the indicator pivots about the projection of the cap.

As would be appreciated by those of skill in the art, the configuration of the groove 46 may also be modified, for example, by changing the angle of the angled section 54, such that the transition from the withdrawn position to the extended position of the indicator is less immediate. Also, the direction of the grooves 46 may be reversed, so that the indicators extend when the cap is rotated in the clockwise direction. This would allow selection of the appropriate status indicator to be incorporated in either a left- or right-handed latch depending on the desired indications in the latched and unlatched condition and latching rotation direction of the latch mechanism. It is preferred that the height from the bottom of the flange of the housing to the top surface of the cap is as short as possible to provide a latch mechanism having a head with a small profile. It is also preferred to provide a relatively deep groove in the housing flange. The peg should also be configured to have a sufficient height and thickness that is approximately the same depth and width of the groove, so that the peg remains positioned within the groove during actuation of the latch and there is no risk of the peg escaping from the groove. A symmetrical design as mentioned above comprising two indicators wherein each indicator is in a respective groove may also be configured, so that the indicators extend in sync during rotation of the cap. It is preferred to include two or more indicators arranged such that the indicators extend substantially about the entire perimeter of the cap when actuated, so that the unlatched condition of the latch is easily recognized from the exposed portions of the indicators. The indicators may also extend at an angle to the central axis of the cap, such that the extended position of the indicators may be recognized from the side of the latch mechanism.

Figure 10:
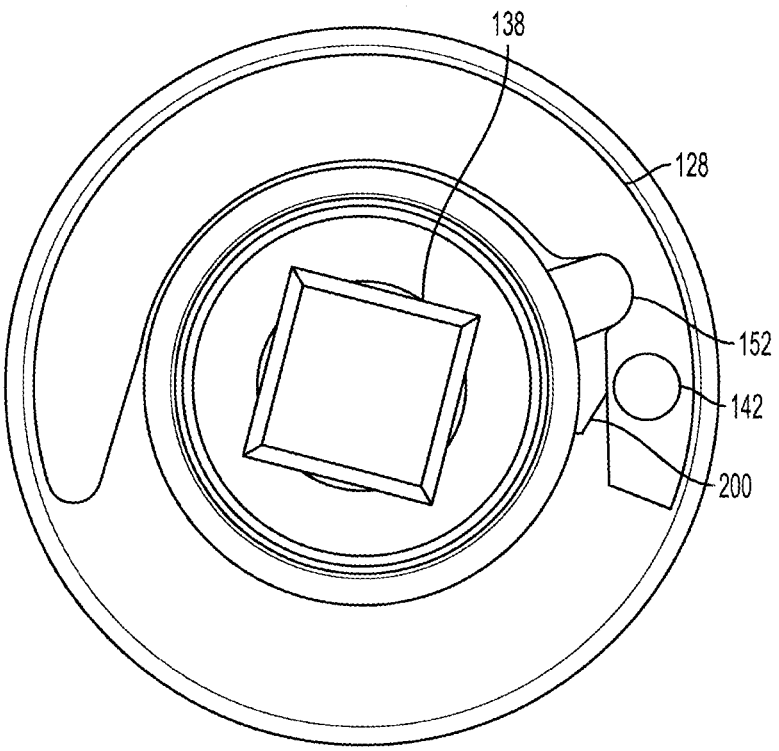
FIG. 10 is top plan view of a latch mechanism in the latched state according to a second embodiment of the present invention.
Figure 11A:
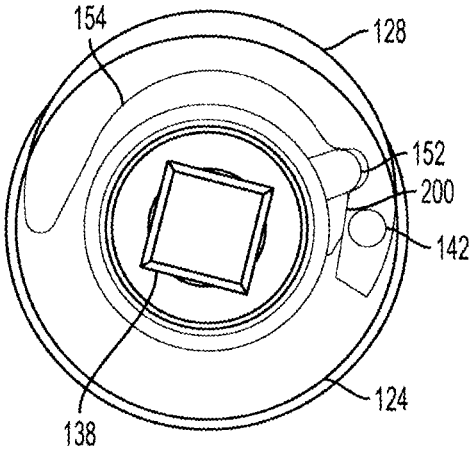
FIGS. 11*a* to 11*c* are top plan views of the latch mechanism of FIG. 10 illustrating a cap of the latch mechanism in various angular positions.
Figure 11B:
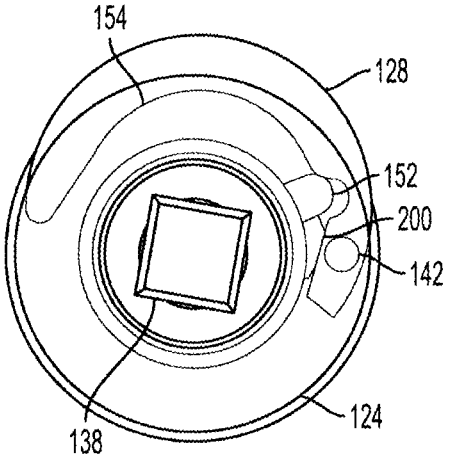
Figure 11C:
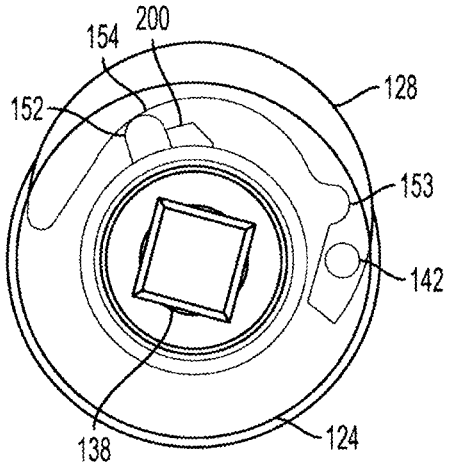
Figure 12A:
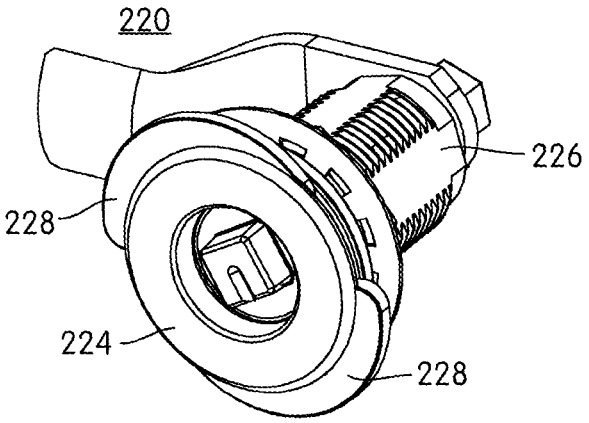
FIG. 12*a* is an isometric view of a latch mechanism in the unlatched state according to a third embodiment of the present invention.
Figure 12B:
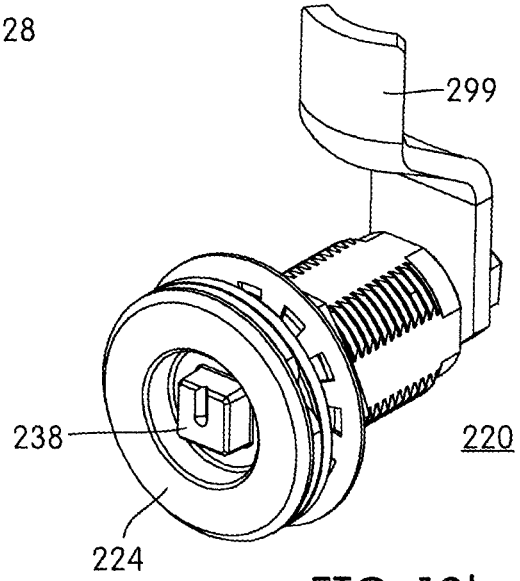
FIG. 12*b* is an isometric view of the latch mechanism of FIG. 12*a* in the latched state.
Figure 12C:
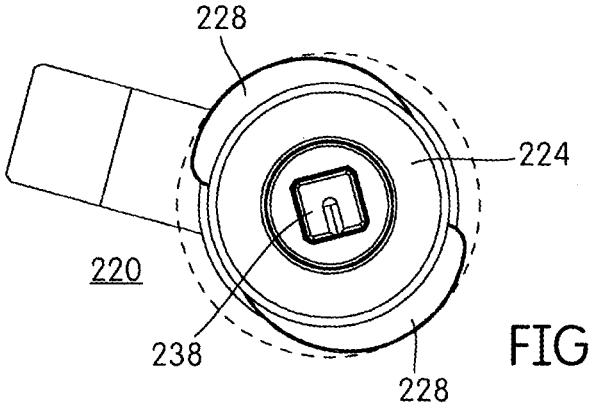
FIG. 12*c* is a top plan view of the latch mechanism of FIG. 12*a* in the unlatched state.
Figure 13:
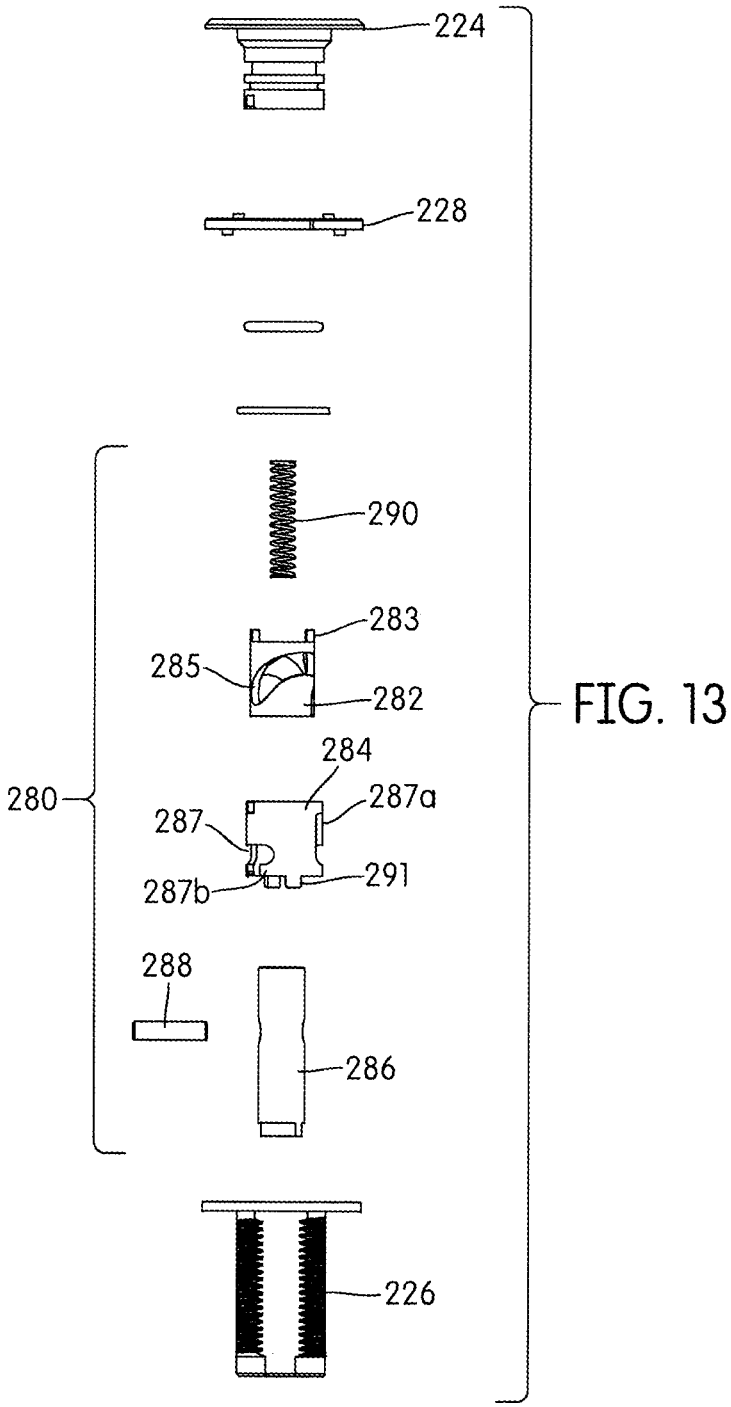
FIG. 13 is an exploded view of a sub-assembly of the latch mechanism of FIG. 12*a;*
Figure 14A:
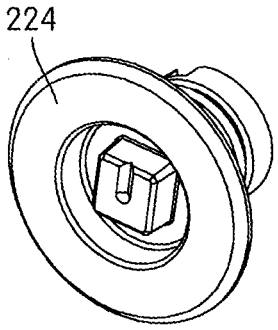
FIG. 14*a* is a top side isometric view of a cap of the latch mechanism in FIG. 12*a;*
Figure 14B:
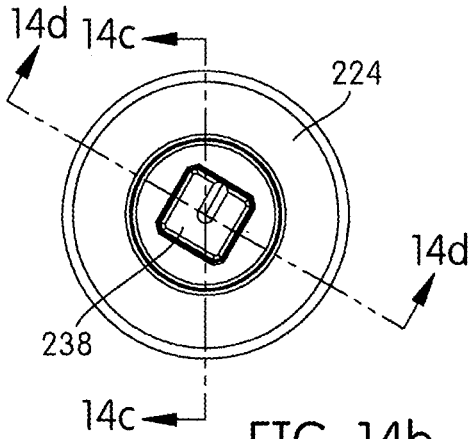
FIG. 14*b* is a top plan view of the cap of FIG. 14*a;*
Figure 14C:
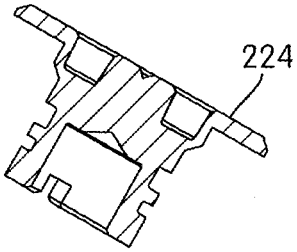
FIG. 14*c* is a cross-section view of the cap of FIG. 14*b* taken along the lines 14*c*-14*c;*
Figure 14D:
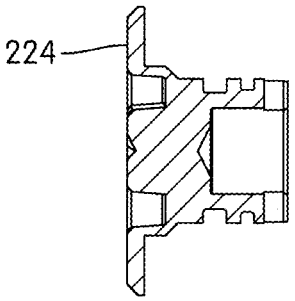
FIG. 14*d* is a cross-section view of the cap of FIG. 14*b* taken along the lines 14*d*-14*d;*
Figure 14E:
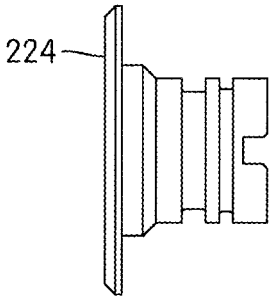
FIG. 14*e* is a side elevation view of the cap of FIG. 14*a;*
Figure 14F:
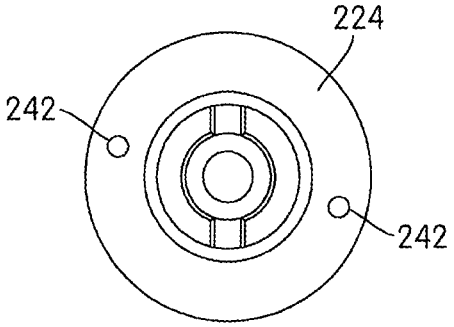
FIG. 14*f* is a bottom plan view of the cap of FIG. 14*a;*
Figure 15A:
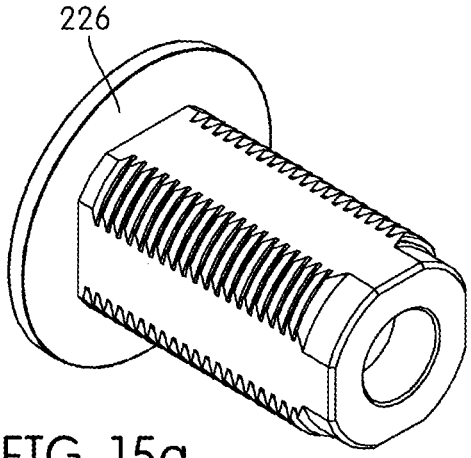
FIG. 15*a* is a bottom side isometric view of a housing of the latch mechanism in FIG. 12*a;*
Figure 15B:
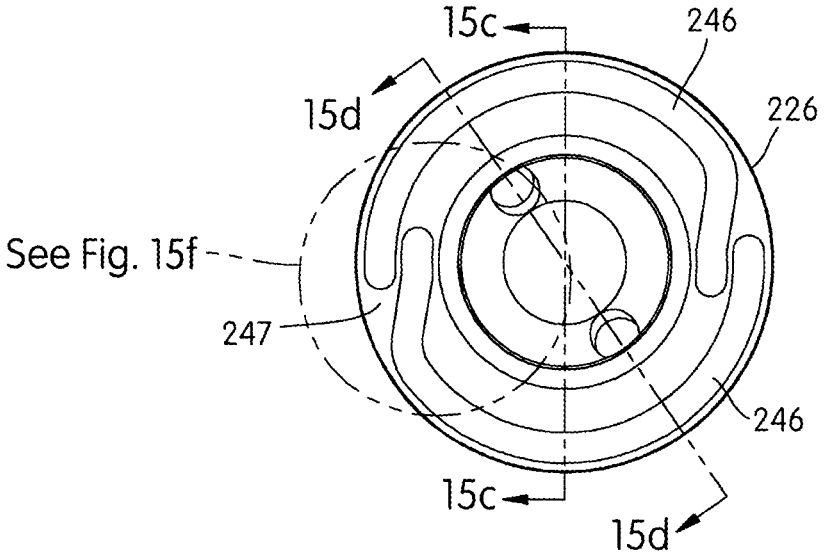
FIG. 15*b* is a top plan view of the housing of FIG. 15*a;*
Figure 15C:
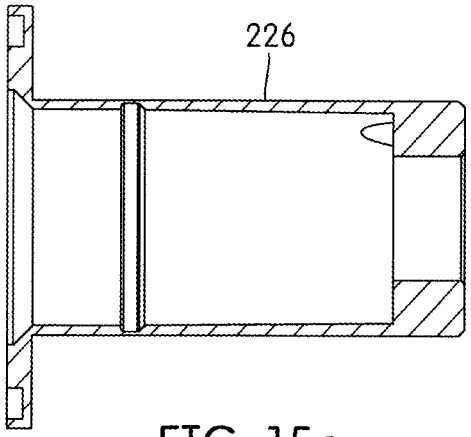
FIG. 15*c* is a cross-section view of the housing of FIG. 15*b* taken along the lines 15*c*-15*c;*
Figure 15D:
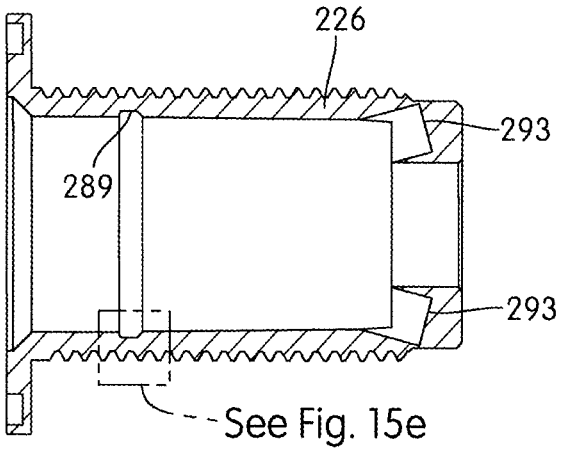
FIG. 15*d* is a cross-section view of the housing of FIG. 15*b* taken along the lines 15*d*-15*d;*
Figure 15E:
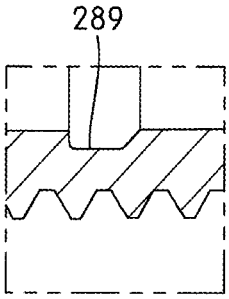
FIG. 15*e* is a detailed view of the housing of FIG. 15*d;*
Figure 15F:
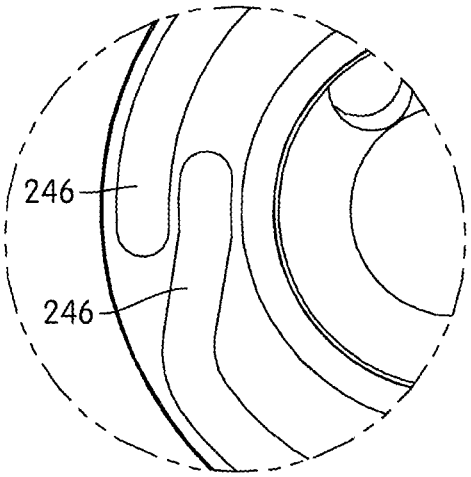
FIG. 15*f* is a detailed view of the housing of FIG. 15*b;*
Figure 15H:
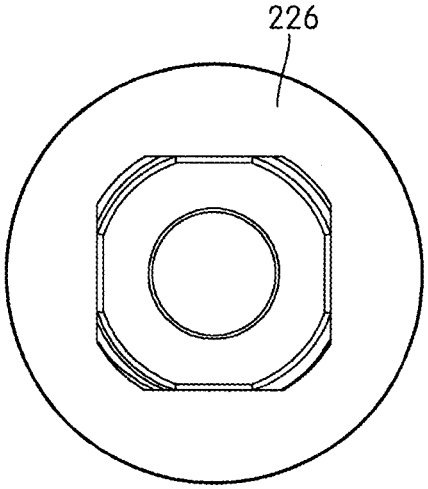
FIG. 15*h* is a bottom plan view of the housing of FIG. 15*a;*
Figure 15G:
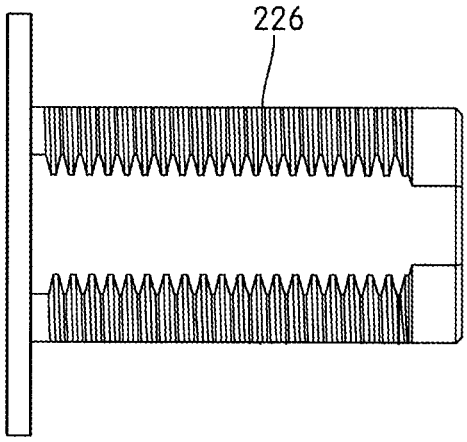
FIG. 15*g* is a side elevation view of the housing of FIG. 15*a;*
Figure 16A:
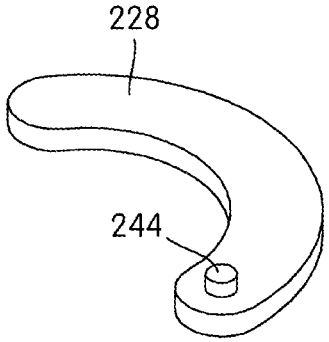
FIG. 16*a* is a top side isometric view of an indicator of the latch mechanism in FIG. 12*a;*
Figure 16B:
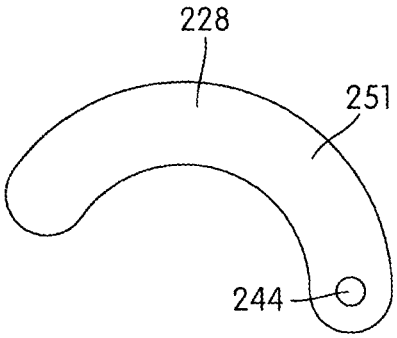
FIG. 16*b* is a top plan view of the indicator of FIG. 16*a;*
Figure 16C:
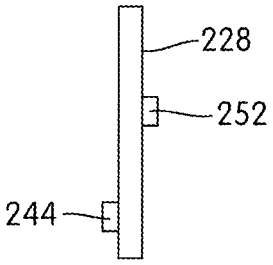
FIG. 16*c* is a side elevation view of the indicator of FIG. 16*a;*
Figure 16D:
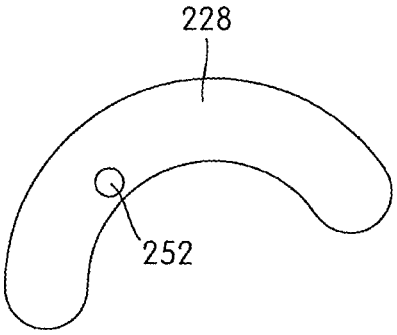
FIG. 16*d* is a bottom plan view of the indicator of FIG. 16*a;*
Figure 17A:
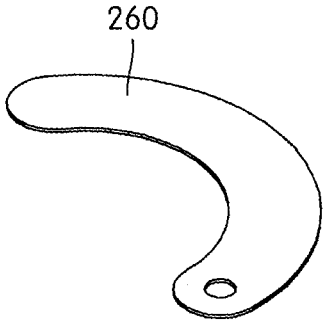
FIG. 17*a* is a top side isometric view of an indicator decal of the latch mechanism in FIG. 12*a;*
Figure 17B:
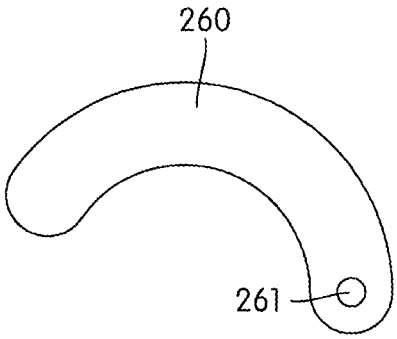
FIG. 17*b* is a top plan view of the indicator decal of FIG. 17*a;*.
Figure 17C:
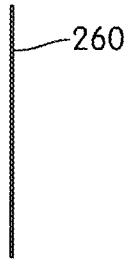
FIG. 17*c* is a side elevation view of the indicator decal of FIG. 17*a.*

An alternative embodiment of a latching mechanism according to the present invention is provided in FIGS. 10 to 11*c*. Similar to the first embodiment, at least one indicator 128 may be interposed between the cap 124 and the housing, such that the cap 124 is in covering relationship to the indicator 128. The cap 124 may also optionally be provided with a square-shaped male portion 138 to mate with a corresponding female portion of a key for rotation of the cap 124. In the second embodiment, however, the indicator 128 does not rotate with the cap 124. A projection 142 extends upwards from the top surface of the housing and through a corresponding bore in the indicator 128. The indicator 128 pivots about the projection 142 during rotation of the cap 124. The cap 124 includes a radially extending pin 152 that resides in a notch 153 of the indicator 128, when the latch mechanism is in the latched condition. As the cap 124 is rotated counter-clockwise, the pin 152 rotates with the cap 124 and urges the indicator 128 to pivot about the projection 142 away from the central axis of the cap 124. The pin 152 continues to slide along a cam surface 154 of the indicator 128 to maintain the indicator in an extended position during rotation of the cap to the fully open unlatched position, preferably after about a 180 degree rotation or less.

In some embodiments, the tip of the indicator 128 opposite to the bore may impinge on a portion of the cap 124 or the housing to prevent the indicator 128 from over extending. When the cap 124 is rotated back 180 degrees in the clockwise direction, the pin 152 will mate with notch 153 and a raised area 200 on the cap 124 adjacent to the pin 152 will push an end of the indicator 128 and urge the indicator 128 back to its original withdrawn position in the latched condition.

In other embodiments, the latching mechanism in FIGS. 10 to 11*c* may further comprise a washer-shaped cover for the cap. The cover may remain fixed during rotation of the cap and offer additional security by only exposing the central male portion 138, which may be accessed only with a driver having the appropriate shape and depth.

Another alternative embodiment of a latching mechanism 220 according to the present invention is provided in FIGS. 12*a* to 17*c*. This alternative embodiment is substantially similar to the first embodiment of FIGS. 1*a* to 9*b*. Similar to the first embodiment, at least one indicator 228 may be interposed between the cap 224 and the housing 226, such that the cap 224 is in covering relationship to the indicator 228. The cap 224 may also optionally be provided with a square-shaped male portion 238 to mate with a corresponding female portion of a key for rotation of the cap 224.

There are several differences between the first embodiment and the third embodiment shown in FIGS. 12*a* to 17*c*. In the third embodiment shown in FIGS. 12*a* to 17*c*, each indicator 228 includes a projection 244 (FIG. 16*a*) that is pivotably inserted into a corresponding bore 242 (FIG. 14*f*) in the bottom surface of the cap 224. In contrast, in the first embodiment, a projection 42 extends from the bottom surface 40 of the cap 24 and through a corresponding bore in one end of the indicator 28. Each indicator 228 also includes a peg 252 (like peg 52) for that is positioned within one of the grooves 246 (like grooves 46) in the top surface 247 of the housing 226.

A sticker or decal 260 (FIG. 17*a*-17*c*) is positioned on the top surface 251 of the indicator 228. The decal 260 includes a hole 261 that is fitted over the projection 244. Like the indicator 28, the decal 260 is a color that is different than the color of the cap 224, such that the indicators 228 when extended are easily recognizable. In lieu of the decal 260, the top surface 251 of the indicator 228 could be painted a different color than the cap 224.

Despite the aforementioned differences, operation of the indicator 228, as well as the entire latching mechanism 220, is generally the same as that of indicator 28 and latching mechanism 20.

Like the latching mechanism 20 of FIGS. 1*a*-9*b*, the latching mechanism 220 includes a cam latch 280, similar to the latch described in U.S. Pat. No. 6,640,592. The cam latch 280 includes a cam 282, a control sleeve 284, a cam follower in the form of a shaft 286 (like shaft 30), a cross-pin 288, and a spring 290.

The cam 282 includes prongs 283 extending from the top end that are engaged with slots on the bottom side of the cap 224, such that the cam 282 rotates along with the cap 224. The cam 282 also includes one or more cam slots 285 defined on the revolved exterior surface.

The control sleeve 284 includes prongs 291 extending from the bottom end that are engaged with slots 293 (FIG. 15*d*) on the bottom interior side of the housing 226, such that the control sleeve 284 remains rotationally fixed with the housing 226. The control sleeve 284 also includes one or more slots 287 defined on the revolved exterior surface. Each slot 287 includes an axially extending slot portion 287*a* and a circumferentially-extending slot portion 287*b*.

In an assembled form of the latching mechanism 220, the cross-pin 288 is fitted through a cross-wise hole in the shaft 286, the slot(s) 287 of the control sleeve 284, and the cam slot(s) 285 of the cam 282. The free ends of the cross-pin 288 are positioned in a circumferential recess 289 (FIG. 15*e*) formed on the interior surface of the housing 226. The spring 290 is configured to bias the cam 282, as well as the cam latch 280, toward the unlatched state.

The operation of the latch when installed as part of an assembly including a door or closure member, will now be described. When cap 224 is rotated, the sleeve-like cam 282 will be driven to rotate in the same direction as the cap 224. When cam 282 is rotated, cross pin 288 is moved, but whether the movement is axial or rotational is dependent upon whether the ends of pin 288 are in the axial slot portions 287*a* or in the circumferential slot portions 287*b* of the motion-control sleeve 284.

When in the latched position, the cap 224 is at its fully clockwise position, and the two opposite ends of cross pin 288 are positioned through the axial slot portions 287*a* of the motion-control sleeve 284, near the ends of the axial slot portions 287*a*. In addition, the portions of the cross pin 288 projecting from either side of the shaft 286, simultaneously engage the cam slots 285 of the cam 282. At the extreme of the clockwise rotation of the cap 224, the projecting portions of the cross pin 288 are positioned nearest to the ends of the cam slots 285 which are closest to the proximal end (i.e., the end closest to the cap 224) of the cam 282. The pitch of each of the cam slots 285 is such that the axial distance, i.e. the distance measured in a direction parallel to the longitudinal axis of the cam 282, between a location along the cam slot 285 and the proximal end of the cam 282 increases in the clockwise direction, beginning at the end of the cam slot nearest the proximal end of the cam 282.

To unlatch the closure member from a door frame (for example), cap 224 is turned in a counterclockwise direction. When this is done, cap 224 and cam 282 rotate as a unit. The cross pin 288 cannot move rotationally because its opposite ends are within the axial slot portions 287*a* of the stationary motion-control sleeve 284. As a result, when cam 282 is rotated counterclockwise, the opposite ends of pin 288 follow the opposed cam slots 285, and as a result, pin 288, and hence also shaft 286 and the pawl 299 (FIG. 12*b*), will move away from the top end 247 of the housing 226 in a direction parallel to the longitudinal axis of the shaft 286. The axial movement of the shaft 286 and the pawl 299, away from the top end 247 of the housing 286 and away from the door frame, continues until the ends of the pin 288 reach the circumferential slot portions 287*b*.

After cap 224 and cam 282 have been rotated as a unit through approximately 120 degrees (for example), cross pin 288 has moved axially away from the proximal end of the motion control sleeve 284, and is now aligned with the opposed circumferential slot portions 287*b*. Further rotation of cap 224 and cam 282 now causes rotational movement of cross pin 288, shaft 286 and pawl 299, as the ends of pin 288 move along the opposed circumferential slot portions 287*b*. In this manner, pawl 299 is moved out of alignment with the door frame, and after approximately 60 degrees of rotation, the closure member or door is fully unlatched from the door frame. The cap 224 has now been rotated approximately 180° (for example) relative to its fully latched position.

The latching action is simply the reverse of the unlatching action just described. On latching, as cap 224 is turned clockwise, the opposite ends of cross pin 288 move in the clockwise direction along the circumferencial slot portions 287*b* and the shaft 286 rotates in the clockwise direction about its longitudinal axis. Then the cross pin 288 translates axially toward the proximal end of the motion control sleeve 284, when the cross pin 288 reaches the axial slot portions 287*a*. These sequential motions are caused by the walls of the cam slots 285, which urge the ends of the cross pin 288 along the circumferential slot portions 287*b* in the clockwise direction, until the ends of the cross pin 288 abut against the edge of the axial slot portions 287*a*. Thereafter, walls of the cam slots 285 urge the ends of the cross pin 288 axially toward the proximal end of the motion control sleeve 284 along the axial slot portions 287*a*. Thus, cam 282 and the motion-control sleeve 284 cooperatively cause the rotational and axial motions of the shaft 286 to take place in sequence, in response to the rotational motion of the cap 224 in the latching or clockwise direction, in one continuous motion.

It should be understood that the latching mechanisms 20 and 220 are not limited to the cam latch 280 that is shown and described herein. In other words, the indicators, caps and housings described herein may be utilized with other latch styles. For example, the indicator(s) may be used with an adjustable grip latch having an externally threaded rod, which is disclosed, for example, in U.S. Pat. Nos. 4,583,775 or 6,640,592, each of which is incorporated by reference herein in its entirety. The indicator(s) described herein may be used with a minimal protrusion fixed grip latch having an internally threaded shaft, which is disclosed, for example, in PCT Patent Application Pub. No. WO/2017/011443, which is also incorporated by reference herein in its entirety. As yet another example, the indicator(s) described herein may be used with non-compression cam latch (non-pull-up), which is disclosed, for example, in U.S. Pat. No. 8,336,931, which is incorporated by reference herein in its entirety. In the standard non-compression type cam latch, the pawl pivots between latched and unlatched positions without translating.

In the present embodiments, the components of the latch mechanism are preferably comprised of metal and metal alloy materials, however, other suitable materials can also be used where desired, such as plastic, aluminum, or zinc. In addition, in the present embodiment, the closure member can be comprised of any suitable materials, such as wood or metal, and can be of varying thickness.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

We claim:

1. A latch mechanism comprising:

a housing;

a cap having a central axis and mounted for selective rotational movement relative to the housing about the central axis between a latched position and an unlatched position; and at least one indicator interposed between the cap and the housing, such that the cap is in covering relationship to at least a portion of the at least one indicator, the at least one indicator being mounted for radial movement outwardly from the central axis relative to the cap as the cap is rotated from the latched position to the unlatched position such that the cap is no longer in covering relationship to the portion of the at least one indicator.

2. The latch mechanism of claim 1, wherein the cap is configured to receive a driver for turning the cap from the latched position to the unlatched position.

3. The latch mechanism of claim 1, wherein the at least one indicator is mounted to the cap such that the at least one indicator pivots about at least one projection as the cap is rotated between the latched position and the unlatched position.

4. The latch mechanism of claim 3, wherein the housing further comprises a first end and a second end, the second end of the housing having an opening and the first end of the housing having a top surface in opposing relationship to the bottom surface of the cap and the at least one indicator is interposed between the top surface and the bottom surface.

5. The latch mechanism of claim 4, wherein the top surface includes at least one guide slot and the at least one indicator includes a peg located within the at least one guide slot, the guide slot being configured such that rotation of the cap from the latched position to the unlatched position causes the at least one indicator to pivot about the at least one projection away from the central axis of the cap.

6. The latch mechanism of claim 4 further comprising:

a cam having at least one cam slot, the cam being rotatably supported within the housing, the cam being coupled to the cap so as to rotate in response to rotation of the cap; and a shaft positioned at least in part within the housing, the shaft extending through the opening in the second end of the housing, the shaft having at least one cam follower located within the at least one cam slot, the at least one cam slot being configured such that the shaft moves rotationally and axially as the cap moves between the unlatched position and the latched position.

7. The latch mechanism of claim 1, wherein the portion of the at least one indicator is colored differently than the cap.

8. The latch mechanism of claim 1 comprising at least two indicators.

9. The latch mechanism of claim 1, wherein the housing further comprises a first end and a second end, the second end of the housing having an opening and the first end of the housing having a top surface, the at least one indicator having at least one projection extending therefrom, wherein the at least one indicator pivots about the at least one projection as the cap is rotated between the latched position and the unlatched position.

10. The latch mechanism of claim 9, wherein the housing further comprises a cam surface and the indicator further comprises a pin configured to slide along at least a portion of the cam surface when the cap is rotated between the latched and the unlatched position to pivot the at least one indicator about the at least one projection.

11. The latch mechanism of claim 9 further comprising:

a cam having at least one cam slot, the cam being rotatably supported within the housing, the cam being coupled to the cap so as to rotate in response to rotation of the cap; and a shaft positioned at least in part within the housing, the shaft extending through the opening in the second end of the housing, the shaft having at least one cam follower located within the at least one cam slot, the at least one cam slot being configured such that the shaft moves rotationally and axially as the cap moves between the unlatched position and the latched position.

12. The latch mechanism of claim 9 further comprising a shaft positioned through the housing, wherein the shaft moves rotationally as the cap moves between the unlatched position and the latched position.

13. A latch mechanism for securing a door to a compartment of a vehicle, said latch mechanism comprising:

a housing configured to be connected to either the door or the compartment;

a cap having a central axis and mounted for selective rotational movement relative to the housing about the central axis between a latched position and an unlatched position; and at least one indicator interposed between the cap and the housing, such that the cap is in covering relationship to at least a portion of the at least one indicator in the latched position of the latch mechanism thereby indicating to a user of the latch mechanism that the latch mechanism is in the latched position and the door is secured to the compartment, the at least one indicator being mounted for radial movement outwardly from the central axis relative to the cap as the cap is rotated from the latched position to the unlatched position such that the cap is no longer in covering relationship to the portion of the at least one indicator thereby indicating to the user of the latch mechanism that the latch mechanism is in the unlatched position and the door is not secured to the compartment.

14. The latch mechanism of claim 13, wherein the cap is configured to receive a driver for turning the cap from the latched position to the unlatched position.

15. The latch mechanism of claim 13, wherein the at least one indicator is mounted to the cap such that the at least one indicator pivots about at least one projection as the cap is rotated between the latched position and the unlatched position.

16. The latch mechanism of claim 15, wherein the housing further comprises a first end and a second end, the second end of the housing having an opening and the first end of the housing having a top surface in opposing relationship to the bottom surface of the cap and the at least one indicator is interposed between the top surface and the bottom surface.

17. The latch mechanism of claim 16, wherein the top surface includes at least one guide slot and the at least one indicator includes a peg located within the at least one guide slot, the guide slot being configured such that rotation of the cap from the latched position to the unlatched position causes the at least one indicator to pivot about the at least one projection away from the central axis of the cap.

18. The latch mechanism of claim 13, wherein the portion of the at least one indicator is colored differently than the cap.

19. The latch mechanism of claim 13 comprising at least two indicators.

* * * * *